United States Patent [19]

Sagawa et al.

[11] 4,047,982

[45] Sept. 13, 1977

[54] PERMANENT MAGNET AND PROCESS FOR PRODUCING THE SAME

[75] Inventors: Masato Sagawa; Takeaki Sakai, both of Yokohama; Tatsuji Sasaki; Zenzo Henmi, both of Kawasaki, all of Japan

[73] Assignee: Fujitsu Limited, Kawasaki, Japan

[21] Appl. No.: 703,367

[22] Filed: July 8, 1976

[30] Foreign Application Priority Data

July 18, 1975 Japan ..... 50-87196

[51] Int. Cl.[2] ..... H01F 1/02; C22C 23/00

[52] U.S. Cl. ..... 148/101; 75/84; 75/152; 148/103; 252/62.57

[58] Field of Search ..... 148/101, 103, 31.57; 75/152, 84; 252/62, 57

[56] References Cited

U.S. PATENT DOCUMENTS

| | | | |
|---|---|---|---|
| 3,326,637 | 6/1967 | Holtzberg et al. | 75/152 |
| 3,947,295 | 3/1976 | Tawara et al. | 148/31.57 |
| 3,982,971 | 9/1976 | Yamanaka et al. | 148/31.57 |

OTHER PUBLICATIONS

Senno, H. et al., *Perm. Mag. Prop. of Sm-Ce-Co-Fe-Cu Alloys,* in *IEE Trans,* 10, June 1974, pp. 313-317.

Nesbitt, E., *New Perm. Mag. Materials,* in *Journ. Appl. Phys.* 40, Mar. 1969, pp. 1259-1265.

Tawara, Y. et al., *Bulk Hardened Magnet,* in *Journ. Appl. Phys.* 12, June 1973, pp. 761-762.

*Primary Examiner*—Walter R. Satterfield

*Attorney, Agent, or Firm*—Staas & Halsey

[57] ABSTRACT

The brittle nature and magnetic properties of the rare earth cobalt magnet are improved by the simultaneous addition of Cu and V. Cu and V are included in amounts of from 0.5 to 6% by weight and from 7 to 19% by weight, respectively. The simultaneous addition enables the rear earth cobalt magnet to be cast in the form of an article. In addition, the simultaneous addition not only improves the mechanical properties of the sintered article, in which form the conventional magnet was available, but also the magnetic properties, such that, for example, the coercive force is increased when the molar ratio of cobalt with respect to rear earth elements is great.

29 Claims, 4 Drawing Figures

PERMANENT MAGNET AND PROCESS FOR PRODUCING THE SAME

BACKGROUND OF THE INVENTION

Field of the Invention

The present invention relates to a material for a magnet and more particularly to a rare earth cobalt type magnet hereinafter referred to as RCo type magnetic material, as well as a process for producing the same.

Description of the Prior Art

As is generally known, the RCo type alloy exhibits excellent magnetic properties when the R component of the alloy includes one of or a mixture including two of Sm, Ce and Pr, and further, the alloy has a crystal structure of the $CaCu_5$ type, or the $Zn_2Th_{17}$ type, or a mixed structure of these two said types. The RCo type-magnet, however has a disadvantage in that the magnetic article is destroyed due to thermal stress, which develops when the alloy is melted by arc-melting or high frequency induction melting or the like and is then cooled down to room temperature. The RCo type magnet, therefore, is not put to use in the cast form. However, contrary to this, a sintered RCo type magnet has undergone research, which resulted in improvement of its properties and manufacturing process, and has actually been commercialized. According to the process for producing the sintered magnet, the known materials are crushed into powder, pressed under the influence of a high magnetic field and then sintered at a suitable elevated temperature. The brittle nature of the RCo type alloy leads not only to the necessity for forming said alloy by a special, careful and contrived method, but also to the impossibility of employing the obtained article as parts which are subjected to high mechanical stress. Attempts have been made to enhance the mechanical properties of the RCo type alloy, so that it could be used as a cast magnet, but the results proved to be unsatisfactory. The previously attempted addition of Cu into the RCo type alloy improved only slightly the mechanical properties thereof, which remained unsatisfactory.

SUMMARY OF THE INVENTION

It is an object of the present invention to provide an RCo type magnet having improved mechanical properties.

It is a further object of the present invention to provide an RCo type sintered magnet which possesses far improved mechanical properties than a conventional RCo type magnet which includes copper as a component.

It is a still further object of the present invention to provide a process, by which the RCo type magnet can be produced by casting.

It is yet another object of the present invention to provide a sintering process, by which the RCo type magnet can be produced without having to take special precautions due to the brittle nature of the magnet.

In accordance with the objects of the invention there is provided an RCo type magnet, wherein the R component is one or more rare earth elements and the Co component is cobalt or both cobalt and iron, and the molar ratio of said R component to said Co component is from 1:5 to 1:8.5, said RCo type magnet being characterized in that a part of said Co component is replaced with both vanadium and copper, in a manner such that the vanadium and the copper are included from 0.5 to 5% by weight and from 7 to 19% by weight, respectively, based on said components R and Co.

The rare earth R component of the present invention can be, for example, one element or a mixture of two or more elements selected from the group consisting of Sm, Ce and Pr. The Co component of the present invention can be pure cobalt or can include iron up to, for example, 5% of the Co component. The molar ratio of the components R to Co can vary from 1:5 to 1:8.5, and determines the crystal structure of the alloy such that an intermetallic compound of either the $CaCu_5$ type or the $Zn_2Th_{17}$ type structure is formed at the molar ratios of 1:5 and 1:8.5, respectively. The mixed phase of the two structures of $CaCu_5$ and $Zn_2Th_{17}$ is formed when the molar ratios vary between 1:5 and 1:8.5.

When either the Co component or rare earth component is included in a greater amount than the above mentioned range between 1:5 and 1:8.5, the resulted alloy cannot serve as a magnet. For example, cobalt contained in a greater amount than the above mentioned range precipitates in the alloy as particles having extremely low coercive force.

The present invention is characterized by the simultaneous addition of vanadium and copper to the above illustrated RCo type alloy, so that a substantial improvement in mechanical strength, which cannot be attained by the addition of only vanadium or only copper, is achieved with regard to every kind of the components R and Co as well as to the entire molar range of the components. The atoms of the Co component are replaced by atoms of the copper and vanadium in the crystal structure of the RCo alloy and, thus, it is said in the present invention that the copper and vanadium replace the Co component.

The mechanical properties of the RCo type alloy are remarkably improved by the simultaneous addition of Cu and V when the molar ratio of the Co-component with respect to the rare earth element, hereinafter referred to as Z-value of the formula $RCo_z$, is not less than 7.2. The Z value should, therefore, preferably be from 7.2 to 8.5.

In addition to the general improvement in the mechanical properties as stated above, the simulantaneous addition of copper and vanadium enables the determination of the best suited molar ratio between the R component and the Co component, from the point of view of the mechanical properties. This ratio for the mechanical properties is inversely proportional to the deterioration of the magnetic properties, when the RCo type alloy includes only copper as an known additional element, and thus could not be employed practically in a case where both excellent magnetic and mechanical properties are required.

When the vanadium content is below 0.5% by weight of the alloy, the meritorious effects of the simultaneous addition of V and Cu are not sufficient to produce the RCo type alloy with improved mechanical properties. When the vanadium content exceeds 6% by weight of the alloy, the saturation magnetization becomes too low. The vanadium content should, therefore, be from 0.5 to 6% of the RCo type alloy. Further, from the point of view of producing a magnet with an excellent squareness ratio in the hysteresis curve, the residual magnetization must not be too low. The vanadium considerably reduces the residual magnetization at more than 3% by weight and, thus, should preferably be included from 0.5 to 3% of the RCo type alloy. From the point of view of preventing the brittleness of the RCo type alloy, copper should be included 7% or more, preferably 9% or more.

The content of copper is determined so that it not only ensures excellent mechanical properties but also excellent magnetic properties.

DETAILED DESCRIPTION OF THE PREFERRED EMBODIMENT

Figure 1:
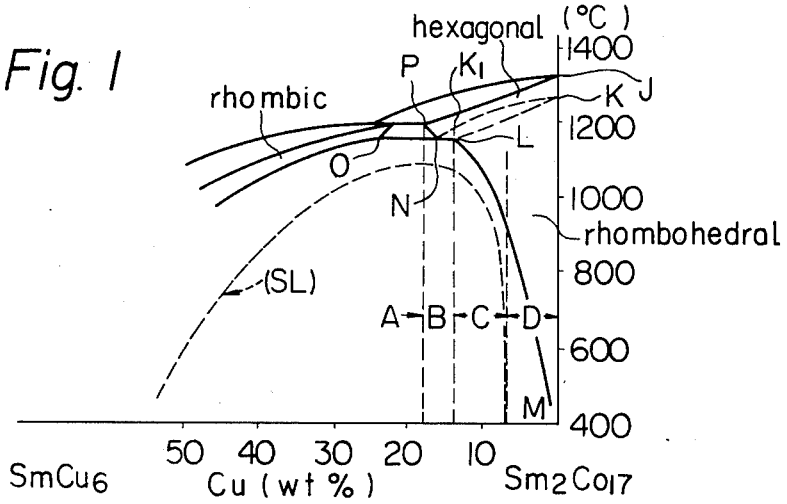
FIG. 1 illustrates a pseudo-binary diagram of a $Sm_2Co_{17}$-$SmCu_6$ system, which diagram was made public by Kaneko et al, in 1974, at the sixth annual conference on Magnetics in Japan.

In FIG. 1, the crystal structure of $Sm_2Co_{17}$ is hexagonal at high temperature and rhombohedral at low temperature. The dashed line curve, denoted by SL in the graph of FIG. 1, represents the spinodal decomposition line. The content of copper can be divided into small ranges A, B, C and D from crystallographic transformation of the alloy during cooling. In the ranges C and D, the rhombohedral crystal of $Sm_2Co_{17}$ separates the rhombic crystal phase along the line LM. Accordingly, it is possible to perform the solution treatment regarding the alloy of the ranges C and D. The range C is distinguished from the range D in the fact that the former falls within the range of the spinodal decomposition line SL. It is therefore believed that suitable ageing followed by the solution treatment can increase the coercive force of the alloy comprising Cu in an amount corresponding to the range C.

In the range B, the hexagonal solid solution separates the rhombic crystal phase along the line PN, or separates the rhombohedral crystal phase along line $K_1N$. The hexagonal solid solution then undergoes the eutectoid reaction at the point N. Accordingly, it is possible to perform the solid solution treatment regarding the alloy of B when the solution temperature is higher than the temperatures of the curves PN and $K_1N$. Since the range B falls within the spinodal decomposition line SL, it is also believed that suitable ageing followed by the solution treatment can increase the coercive force of the alloy in the range B.

In the region A, no phases precipitate in the matrix of the $Sm_2Co_{17}$ crystal, but the $Sm_2Co_{17}$ crystal precipitates in the matrix of the rhombic crystal.

In conclusion, the copper content of the RCo type alloy must be in the ranges B and C, that is, from 7 to 19% by weight from the point of view of achieving high coercive force.

The inventors discovered, however, that if the copper content exceeds 15% by weight, the squareness ratio is reduced. It is therefore preferable to include copper in an amount of not more than 15%, when a high squareness ratio is desired.

The permanent magnet, according to the present invention, can advantageously be produced by melting the required ingredients and solidifying the obtained melt in a vessel. As is known in the art of magnetic material, the heat is withdrawn through the vessel in a predetermined direction. The solidifying process can be perfomed by casting the melt into a mold which may have substantially the same shape as that of the desired finished cast goods. Said mold can be a metallic mold for obtaining good surface qualities and accurate dimensions in the resultant cast article. The melt is cooled in the metallic mold to room temperature at a considerably higher cooling rate than the rate which would have caused formation of cracks in the RCo type alloy not containing V and Cu.

The RCo type magnet can also be produced by the conventional sintering technique by pressing the powder at a pressure of 2 to 5 ton/cm$^2$ under the influence of a magnetic field and sintering a green compact at a temperature of 1150° to 1200° C in a vacuum of preferably lower than the value of $10^{-4}$ torr.

The product produced either by casting or sintering, is solution-treated at a temperature in the homogeneous hexagonal or the rhombohedral regions, and then cooled to room temperature. It is advisable that the sintering and heating at the solution temperature are simultaneously performed, and immediately after the heating the sintered article is rapidly cooled from the solution temperature to room temperature. The solution treated article is aged at a temperature of from 700° to 820° C, preferably 750° to 820° C.

The invention is explained further by way of the following Examples.

EXAMPLE 1

RCo type alloys of different compositions were melted in a conventional arc furnace, and the obtained melts were cast into a water cooled mold made of copper to produce samples weighing 40 grams. The melt was cooled down in the copper mold to room temperature.

Table 1 shows the chemical compositions of the tested samples as well as the effects of the cooling stress upon the samples.

The cooled samples were observed to determine whether or not said samples were cracked due to the cooling stress.

Table I

| Sample No. | Types of Alloy | | Weight Percentage of the Components | | | | | | | Results of Cooling |
|---|---|---|---|---|---|---|---|---|---|---|
| | | | Sm | Ce | Pr | Co | Cu | V | Fe | |
| 1. (control) | R $Co_5$ | Sm $Co_5$ | 33.8 | | | 66.2 | | | | X |
| 2. (control) | R $Co_5$ | $Sm(CO_{0.7}Cu_{0.3})_5$ | 33.3 | | | 45.6 | 21.1 | | | X |
| 3. (control) | R $Co_5$ | $Sm(Co_{0.65}Cu_{0.3}V_{0.05})_5$ | 33.4 | | | 42.6 | 21.2 | 2.8 | | O |
| 4. (control) | R $Co_{7.4}$ | Sm $CO_{7.4}$ | 25.7 | | | 74.3 | | | | X |
| 5. (control) | R $Co_{7.4}$ | $Sm(Co_{0.8}Cu_{0.2})_{7.4}$ | 25.4 | | | 58.8 | 15.8 | | | Δ |
| 6. (invention) | R $Co_{7.4}$ | $Sm(Co_{0.75}Cu_{0.2}V_{0.05})_{7.4}$ | 25.5 | | | 55.4 | 15.9 | 3.2 | | O |
| 7. (control) | R $Co_{7.4}$ | $Sm(Co_{0.75}V_{0.25})_{7.4}$ | 26.3 | | | 57.2 | 16.5 | | | X |
| 8. (control) | R $Co_{8.5}$ | Sm $Co_{8.5}$ | 23.1 | | | 76.9 | | | | Δ |

Table I-continued

| Sample No. | Types of Alloy | | Weight Percentage of the Components Sm | Ce | Pr | Co | Cu | V | Fe | Results of Cooling |
|---|---|---|---|---|---|---|---|---|---|---|
| 9. (control) | R $Co_{8.5}$ | $Sm(Co_{0.8}Cu_{0.2})_{8.5}$ | 22.8 | | | 60.8 | 16.4 | | | Δ |
| 10. (invention) | R $Co_{5.5}$ | $Sm(Co_{0.75}Cu_{0.2}V_{0.05})_{5.5}$ | 31.5 | | | 50.9 | 14.6 | 3.0 | | O |
| 11. (control) | R $Co_{7.4}$ | $Sm_{0.7}Ce_{0.3}(Co_{0.8}Cu_{0.2})_{7.4}$ | 17.9 | 7.1 | | 59.1 | 15.9 | | | Δ |
| 12. (invention) | R $Co_{7.4}$ | $Sm_{0.7}Co_{0.3}(Co_{0.75}Cu_{0.2}V_{0.05})_{7.4}$ | 17.9 | 7.2 | | 55.7 | 16.0 | 3.2 | | O |
| 13. (invention) | R $Co_{7.4}$ | $Ce(Co_{0.75}Cu_{0.2}V_{0.05})_{7.4}$ | | 24.3 | | 56.3 | 16.2 | 3.2 | | O |
| 14. (invention) | R $Co_{7.4}$ | $Sm_{0.7}Pr_{0.3}(Co_{0.75}Cu_{0.2}V_{0.05})_{7.4}$ | 17.9 | | 7.2 | 55.7 | 16.0 | 3.2 | | O |
| 15. (invention) | R $Co_{7.4}$ | $Sm_{0.7}Ce_{0.3}(Co_{0.78}Fe_{0.05}Cu_{0.15}V_{0.02})_{7.4}$ | 18.0 | 7.2 | | 58.0 | 12.0 | 1.3 | 3.5 | O |
| 16. (invention) | R $Co_{7.4}$ | $Sm(Co_{0.78}Cu_{0.2}V_{0.02})_{7.4}$ | 25.4 | | | 57.4 | 15.9 | 1.3 | | O |
| 17. (invention) | R $Co_{7.4}$ | $Sm(CO_{0.792}Cu_{0.2}V_{0.008})_{7.4}$ | 25.4 | | | 58.2 | 15.9 | 0.5 | | O |
| 18. (control) | R $Co_{7.4}$ | $Sm(Co_{0.795}Cu_{0.2}V_{0.05})_{7.4}$ | 25.4 | | | 58.4 | 15.9 | 0.3 | | Δ |
| 19. (control) | R $Co_{7.6}$ | $Sm_{0.7}Ce_{0.3}(Co_{0.85}Fe_{0.85}Cu_{0.07}V_{0.03})_{7.6}$ | 17.7 | 7.1 | | 64.1 | 5.7 | 1.9 | 3.5 | Δ |
| 20. (invention) | R $Co_{7.6}$ | $Sm_{0.7}Ce_{0.3}(Co_{0.81}Fe_{0.05}Cu_{0.11}V_{0.03})_{7.6}$ | 17.7 | 7.1 | | 61.0 | 8.9 | 1.8 | 3.5 | O |
| 21. (invention) | R $Co_{7.6}$ | $Sm_{0.7}Ce_{0.3}(Co_{0.77}Fe_{0.05}Cu_{0.15}V_{0.03})_{7.6}$ | 17.7 | 7.0 | | 57.9 | 12.1 | 1.8 | 3.5 | 0 |

In Table 1, the mark X represents the samples which were broken into a number of fine fragments, the mark Δ represents the samples which were either cracked but not separated into fragments or broken into several fragments, and the mark 0 represents the samples which were not cracked at all.

As seen in Table 1, a first group of the samples No. 1, 4, and 8, which included neither V nor Cu, exhibited brittleness and a second group of the samples No. 2, 5, 7, 9, and 11, which included either V or Cu, exhibited no improvement at all or a slight improvement of the cracking tendency as compared with the first group. Contrary to this, a third group of the samples, which included both V and Cu, were not cracked at all, except for samples No. 18 and 19. The sample No. 18, which included the lowest amount of V in the third group, was cracked. It will, therefore, be apparent that the simultaneous addition of V and Cu improves the brittleness of the RCo type alloy, when the vanadium is added in a certain amount. The lowest limit of the vanadium content should be 0.5% by weight of the sample (c.f. No. 17). The sample No. 19, which included approximately 6% of Cu, i.e. the lowest amount of Cu in the third group, was cracked. The lower limit of Cu should, therefore, be not less than 7% by weight of the sample. The samples of the invention containing 9% of and more of Cu (Nos. 20, 21, 12 through 17) do not present problems of brittleness at all.

It will also be apparent from Table I that the simultaneous addition of Cu and V is effective with regard to the conditions:

1. wherein all the molar ratios of 1:5 (No. 3), 1:7.4 (No. 12, 13, 14), and 1:8.5 (No. 10) are for the rare earth component and the Co component;
2. wherein several kinds of rare earth elements are: Sm, Ce, a combination of Sm with Ce, and a combination of Sm with Pr;
3. wherein the Co component is partly replaced by Fe,

EXAMPLE 2

RCo type alloys of different compositions were produced by a conventional melting process using an arc furnace. The obtained melt was then poured into a mold to produce ingots, each weighing 40 grams.

The produced alloys were then coarsely crushed by a crusher into powder of approximately 3 mm in grain size. The powder was, then, finely crushed by a mortar grinding machine into powder of approximately 40 μm or under in grain size.

The obtained powder was, then, pressed at a pressure of 5 ton/cm² under a magnetic field of 7000 Oe to produce green compacts in the form of round bars having dimensions of 4.5 mm in diameter and 15 mm in length. All of the green compacts were sintered at a temperature of 1175° C under a vacuum of $10^{-5}$ torr. Immediately after the sintering, the specimens were rapid cooled by the blowing of argon gas thereon.

The sintered articles in the form of round bars were subjected to an impact strength measurement by the Izod method. The chemical compositions and the impact strengths of the samples are shown in Table II.

Table II

| Sample No. | | Type of alloy | Weight percentage of the components Sm | Ce | Co | Cu | V | Fe | Relative impact strength |
|---|---|---|---|---|---|---|---|---|---|
| 1. (control) | R $Co_5$ | $Sm(Co_{0.7}Cu_{0.3})_5$ | 33.3 | | 45.6 | 21.1 | | | 1.0 |
| 2. (control) | R $Co_5$ | $Sm(Co_{0.65}Cu_{0.35})_5$ | 33.2 | | 42.3 | 24.5 | | | 1.0 |
| 3. (control) | R $Co_{7.4}$ | $Sm_{0.7}Co_{0.3}(Co_{0.3}Fe_{0.05}Cu_{0.15})_{7.4}$ | 17.9 | 7.2 | 59.4 | 12.0 | | 3.5 | 1.5 |
| 4. (invention) | R $Co_5$ | $Sm(Co_{0.65}Cu_{0.3}V_{0.05})_5$ | 33.4 | | 42.6 | 21.2 | 2.8 | | 2.0 |
| 5. (invention) | R $Co_{7.2}$ | $Sm_{0.7}Ce_{0.3}(Co_{0.76}Fe_{0.05}Cu_{0.15}V_{0.04})_{7.2}$ | 18.4 | 7.3 | 56.2 | 12.0 | 2.6 | 3.5 | 4.0 |
| 6. (invention) | R $Co_{7.4}$ | $Sm_{0.7}Ce_{0.3}(Co_{0.78}Fe_{0.05}Cu_{0.15}V_{0.02})_{7.4}$ | 18.0 | 7.2 | 58.0 | 12.0 | 1.3 | 3.5 | 4.0 |
| 7. (invention) | R $Co_{7.4}$ | $Sm_{0.7}Ce_{0.3}(Co_{0.77}Fe_{0.05}Cu_{0.15}V_{0.03})_{7.4}$ | 18.0 | 7.2 | 57.3 | 12.0 | 2.0 | 3.5 | 4.25 |

As seen from Table II, the simultaneous addition of Cu and V increases the relative impact strengths of the $RCo_5$ type alloys by twice as much (compare No. 4 with Nos. 1 and 2) and also increases the impact strengths of the $RCo_{7.2\text{-}7.4}$ alloys by approximately three times (compare Nos. 5, 6 and 7 with No. 3). The simultaneous addition of Cu and V is, therefore, effective in improving the mechanical properties of sintered articles in addition to improving the mechanical properties of cast articles.

EXAMPLE 3

The process of Example 2 was repeated except that: (1) the compositions tested were expressed by the formula $$Sm_{0.7}Ce_{0.3}(C_{0.8-x}Fe_{0.05}Cu_{0.15}V_x)_z,$$

wherein $x$=0.006, 0.026, 0.046, 0.006, 0.086 and 0.1, $z$=7.2 and 7.6, and (2) the green compacts were rectangular parallelepipeds and each had a dimension of 5.0mm × 5.0mm × 9.0mm. The specimens were subjected to the measurement of saturation magnetization.

Figure 2:
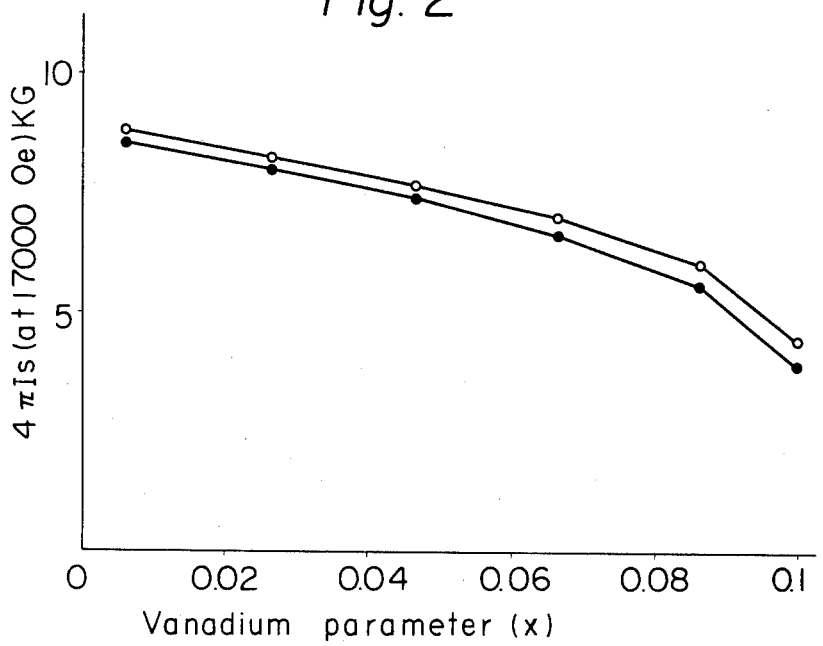
FIG. 2 is a plot of saturation magnetization measurements of the specific composition of Example 3 with different amounts of vanadium content.

FIG. 2 illustrates the results of the measurements on a graph, wherein the abcissa represents the vanadium content expressed in terms of a vanadium parameter, i.e., the x-value in the above formula, and the ordinate represents the saturation magnetization in terms of a magnetization $4\pi I_S$, in the magnetic field of 17000 Oe. The z-values of 7.6 or 7.2, correspond to line -O- and line -.-, respectively in the figure.

As seen in FIG. 2, the value $4\pi I_S$ decreases with an increase in the vanadium parameter $x$ and the decrease becomes sharper at the vanadium parameter of more than 0.08, i.e., 6% by weight of the vanadium of the weight of the alloy. In order to provide the RCo type alloy with a suitable saturation magnetization for being used as a permanent magnet, the vanadium parameter should, therefore, be 0.08 or less.

EXAMPLE 4

The process of Example 2 was repeated with regard to the five compositions in Table III below, to produce ten specimens of a transverse rupture stress for every composition. The transverse rupture stress was measured and the results shown in Table III were obtained.

Table III

| Sample No. | | Type of alloy | Weight percentage of the components Sm | Ce | Co | Cu | V | Fe | Transverse rupture stress (kg/mm²) |
|---|---|---|---|---|---|---|---|---|---|
| 1. (control) | $RCo_5$ | $Sm_{0.7}Ce_{0.3}(Co_{0.7}Cu_{0.3})_5$ | 23.3 | 9.3 | 46.2 | 21.2 | | | 5 |
| 2. (control) | $RCo_5$ | $Sm_{0.7}Ce_{0.3}(Co_{0.68}Cu_{0.3}V_{0.02})_5$ | 23.7 | 9.4 | 44.7 | 21.3 | 0.9 | | 5 |
| 3. (control) | $RCo_{7.2}$ | $Sm_{0.7}Ce_{0.3}(Co_{0.80}Fe_{0.05}Cu_{0.15})_{7.2}$ | 18.7 | 7.3 | 59.5 | 11.0 | | 3.5 | 8 |
| 4. (invention) | $RCo_{7.2}$ | $Sm_{0.7}Ce_{0.3}(Co_{0.78}Fe_{0.05}Cu_{0.15}V_{0.02})_{7.2}$ | 18.7 | 7.3 | 58.3 | 11.0 | 1.2 | 3.5 | 9.5 |
| 5. (invention) | $RCo_{7.6}$ | $Sm_{0.7}Ce_{0.3}(Co_{0.80}Fe_{0.05}Cu_{0.15})_{7.6}$ | 17.5 | 7.0 | 59.8 | 12.2 | | 3.5 | 14 |
| 6. (control) | $RCo_{7.6}$ | $Sm_{0.7}Ce_{0.3}(Co_{0.78}Fe_{0.05}Cu_{0.15}V_{0.02})_{7.6}$ | 16.7 | 6.7 | 60.3 | 11.7 | 1.2 | 3.4 | 18 |

As is clear in Table III, the transverse rupture stress increases in the sequence of No. 1 ($RCo_5$), No. 3 ($RCo_{7.2}$) and No. 5 ($RCo_{7.6}$), as well as No. 2 ($RCo_5$), No. 4 ($RCo_{7.2}$) and No. 6 ($RCo_{7.6}$), and thus increases with an increase in the $z$-value. As is also apparent in Table III, the difference in the transverse rupture stress brought about by the simultaneous addition of Cu and V is not observed when the $z$-value is 5 (sample Nos. 1 and 2), but becomes appreciable when the $z$-value is increased to 7.2 (Nos. 3 and 4). In the samples Nos. 3 through 6, the transverse rupture stress is higher in the alloys simultaneously containing Cu and V than in the alloys containing only Cu, on the condition that the $z$-values are equal.

EXAMPLE 5

The process of Example 3 was repeated with regard to the six compositions in Table IV below, to produce the specimens for the measurement of magnetic properties. The specimens were subjected to the measurement of coercive force (Hc), residual magnetization (Br) and the energy product (BH)max. The results are shown in Table IV.

As seen in Table IV, the coercive force of the RCo type alloys containing only Cu as an additional element sharply decreases with the increase in the $z$-value (c.f. Nos. 1, 3, and 5). Contrary to this, the coercive force of the RCo type alloys containing both Cu and V as additional elements does not necessarily decrease with an increase in the $z$-value, but increases when the $z$-value changes from 7.5 (No. 4) to 7.8 (No. 6). It is, therefore, concluded that the simultaneous addition of Cu and V remarkably contributes to prevent a decrease of, and even to increase, the coercive force of the RCo type alloy having a high $z$-value.

EXAMPLE 6

Figure 3:
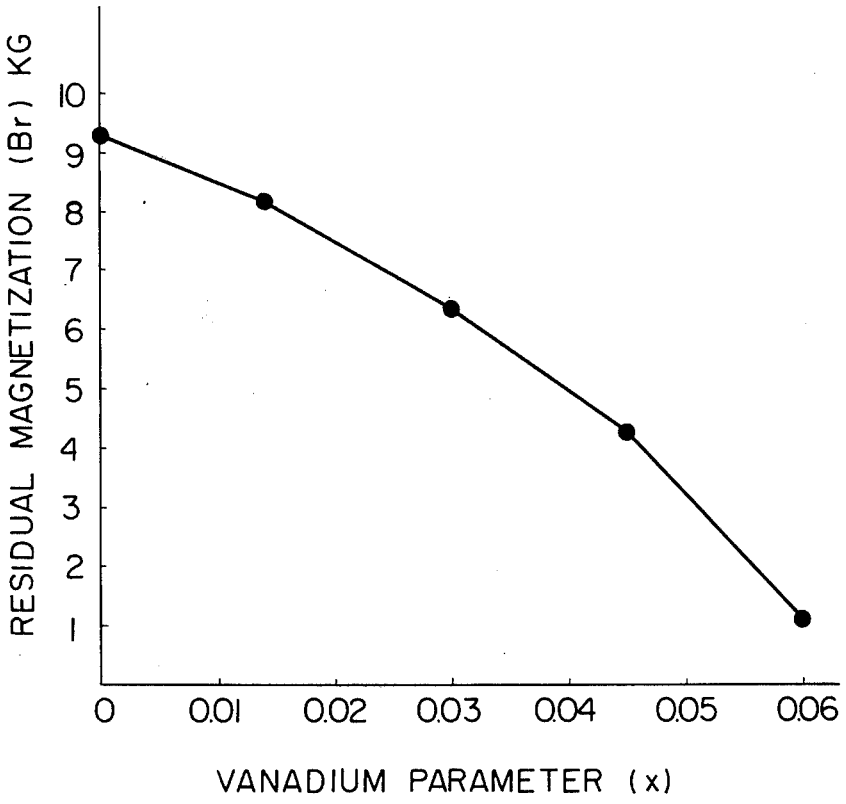
FIG. 3 is a plot of residual magnetization measurements of the specific composition of Example 6 with different amounts of vanadium content.

The process of Example 3 was repeated except that the compositions tested were expressed by the formula:

$$Sm_{0.7}Ce_{0.3}(Co_{0.8-x}Fe_{0.05}Cu_{0.15}V_x)_{7.6},$$

wherein $x=0$, 0.014, 0.030, 0.045 and 0.060. The $x$-values of 0.015, 0.030, 0.045 and 0.060 correspond to 0.89, 1.9, 2.7 and 3.6% by weight, respectively. The specimens were subjected to the measurement of residual magnetization. FIG. 3 illustrates the results of the measurement on a graph, wherein the abscissa represents the vanadium content expressed in terms of a vanadium parameter, i.e. the $x$-value in the above formula, and the ordinate represents the residual magnetization density Br. As seen in this graph, the residual magnetization decreases with an increase in the vanadium parameter, and sharply decreases at a vanadium parameter of more than 0.045. The vanadium should therefore be not more than 3% by weight of V.

EXAMPLE 7

The process of Example 3 was repeated except that the compositions tested were expressed by the formula:

$$Sm_{0.7}Ce_{0.3}(Co_{0.935-y}Fe_{0.05}Cu_yV_{0.015})_{7.6},$$

wherein $y=0.11$, 0.15, 0.19 and 0.21. The $y$-values of 0.11, 0.15, 0.19 and 0.21 correspond to 9, 12, 15 15 17% by weight of Cu, respectively. The specimens were subjected to the measurement of residual magnetization, Ir, and magnetization in a magnetic field of 15000 Oe, $I_{15000}$.

Figure 4:
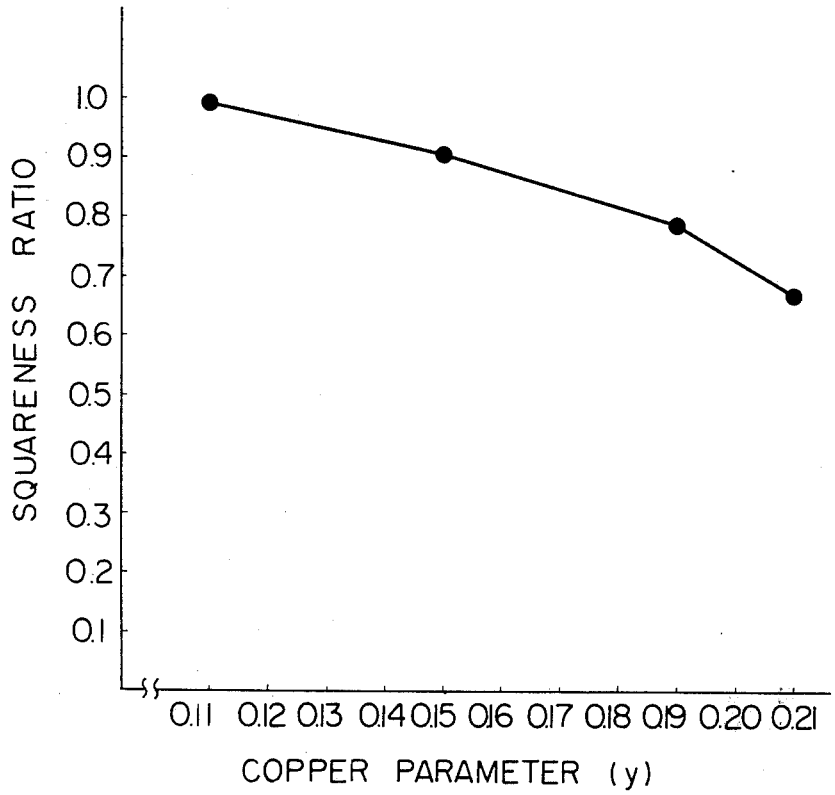
FIG. 4 is a plot of the squareness ratio measurement determined by the ratio of residual magnetism $I_r$/magnetic field $I_{1500}$ against different amounts of copper in the specific composition of Example 7.

FIG. 4 illustrates the squareness ratio determined by the ratio $Ir/I_{15000}$, on a graph, wherein the abscissa and Table IV

| Sample No. | | Types of alloy | Weight percentage of the components Sm | Ce | Co | Cu | V | Fe | Magnetic properties Hc (KOe) | Br (KG) | (BH)max M Oe G |
|---|---|---|---|---|---|---|---|---|---|---|---|
| 1(control) | $RCo_{7.2}$ | $Sm_{0.7}Ce_{0.3}(Co_{0.8}Fe_{0.5}Cu_{0.15})_{7.2}$ | 18.7 | 7.3 | 59.5 | 11.0 | 0 | 3.5 | 5.0 | 9.0 | 14 |
| 2(invention) | $RCo_{7.2}$ | $Sm_{0.7}Ce_{0.3}(Co_{0.785}Fe_{0.05}Cu_{0.15}V_{0.015})_{7.2}$ | 18.7 | 7.3 | 58.6 | 11.0 | 0.9 | 3.5 | 6.0 | 8.0 | 13 |
| 3(control) | $RCo_{7.5}$ | $Sm_{0.7}Ce_{0.3}(Co_{0.8}Fe_{0.05}Cu_{0.15})_{7.5}$ | 17.8 | 7.2 | 60.0 | 12.0 | 0 | 3.0 | 4.0 | 9.0 | 11 |
| 4(invention) | $RCo_{7.5}$ | $Sm_{0.7}Ce_{0.3}(Co_{0.8}Fe_{0.05}Cu_{0.15}V_{0.015})_{7.5}$ | 19.8 | 7.9 | 66.6 | 1.3 | 1.1 | 3.3 | 5.0 | 8.2 | 11 |
| 5(control) | $RCo_{7.8}$ | $Sm_{0.7}Ce_{0.3}(Co_{0.85}Cu_{0.15})_{7.8}$ | 17.1 | 6.9 | 63.9 | 12.1 | 0 | 0 | 2.0 | 8.8 | 7 |
| 6(invention) | $RCo_{7.8}$ | $Sm_{0.7}Ce_{0.3}(Co_{0.835}Cu_{0.15}V_{0.015})_{7.8}$ | 17.1 | 6.9 | 62.9 | 12.1 | 1.0 | 0 | 5.5 | 8.0 | 11 |

ordinate represent the copper parameter i.e. the $y$-value in the above formula, and the squareness ratio, respectively.

As seen in the graph the squareness ratio decreases with an increase in the $y$-value. The squareness ratio should preferably be not less than 0.80 and, thus, a $y$-value of not more than 0.19, corresponding to 19% by weight of the sample, is desirable.

What we claim is:

1. In a permanent magnet of an RCo type, wherein the R component Co is cobalt or both cobalt and iron, and the molar ratio of said R component to said Co component is from 1:5 to 1:8.5, an improvement comprising replacing a part of said Co component with both vanadium and copper, in a manner such that said vanadium and said copper are included from 0.5 to 6% by weight, respectively, based on said components R and Co.

2. A permanent magnet according to claim 1, wherein said rare earth elements, consist of a group of samarium, cerium and praseodymium.

3. A permanent magnet according to claim 2, wherein said R component is samarium.

4. A permanent magnet according to claim 2, wherein said R component is cerium.

5. A permanent magnet according to claim 2, wherein said R component is samarium and cerium.

6. A permanent magnet according to claim 2, wherein said R component is samarium and praseodymium.

7. A permanent magnet according to claim 1, wherein said vanadium and said copper are included from 0.5 to 3% by weight and from 9 to 15% by weight, respectively.

8. A permanent magnet according to claim 7, wherein said rare earth elements consist of a group of samarium, cerium and praseodymium.

9. A permanent magnet according to claim 8, wherein said R component is samarium.

10. A permanent magnet according to claim 8, wherein said component is cerium.

11. A permanent magnet according to claim 8, wherein said R component is samarium and cerium.

12. A permanent magnet according to claim 8, wherein said R component is samarium and praseodymium.

13. A permanent magnet according to claim 1, wherein said molar ratio is from 1:7.2 to 1:8.5, and said vanadium and said copper are included from 0.5 to 3% by weight and from 9 to 15% by weight, respectively.

14. A permanent magnet according to claim 13, wherein said rare earth elements consist of a group of samarium, cerium and praseodymium.

15. A permanent magnet according to claim 14, wherein said R component is samarium.

16. A permanent magnet according to claim 15, wherein said component is cerium.

17. A permanent magnet according to claim 16, wherein said R component is samarium and cerium.

18. A permanent magnet according to claim 17, wherein said R component is samarium and praseodymium.

19. In a process for producing a permanent magnet of an RCo type, wherein the component R is one or more rare earth elements and the component Co is cobalt or both cobalt and iron, and the molar ratio of said R component to said Co component is from 1:5 to 1:8.5, an improvement comprising adding vanadium and copper to said components R and Co and melting the resultant mixture, wherein a part of said Co component is replaced with both vanadium and copper in a manner such that said vanadium and said copper are included from 0.5 to 3% by weight and from 9 to 15% by weight, respectively.

20. In a process for producing a permanent magnet of an RCo type, wherein the component R is one or more rare earth elements and the component Co is cobalt or both cobalt and iron, and the molar ratio of said R component to said Co component is from 1:5 to 1:8.5, an improvement comprising adding vanadium and copper to said components R and Co, melting the resultant mixture, wherein a part of said Co component is replaced with both vanadium and copper, in a manner such that said vanadium and said copper are included from 0.5 to 6% by weight and from 7 to 19% by weight, respectively, based on said components R and Co, solidifying the obtained melt in a vessel, through which the heat is withdrawn in a predetermined direction and solution-treating and ageing the solidified melt.

21. A process according to claim 20, wherein said solution treatment is performed at a temperature of from 1150° to 1210° C, and said ageing is performed at a temperature of from 700° to 820° C.

22. A process according to claim 20, wherein said vanadium and said copper are included from 0.5 to 3% by weight and from 9 to 15% by weight, respectively.

23. A process according to claim 22, wherein said solution treatment is performed at a temperature of from 1150° to 1210° C, and said ageing is performed at a temperature of from 700° to 820° C.

24. In a process for producing a permanent magnet of a RCo type, wherein the R component is one or more rare earth elements and the Co component is cobalt or both cobalt and iron, and the molar ratio of said R component to said Co component is from 1:5 to 1:8.5, said process comprising the steps of pressing a powder consisting of said components, and sintering said pressed powder, an improvement comprising replacing a part of said Co component with both vanadium and copper, in a manner such that said vanadium and said copper are included from 0.5 to 6% by weight and from 7 to 19% by weight, respectively, based on said components R and Co.

25. A process according to claim 24, wherein said pressing is performed at a pressure of 2 to 5 ton/cm$^2$, which a magnetic field is applied to the powder being pressed, said sintering is performed at a temperature from 1150° C to 1210° C under vacuum, said solution treatment is performed at a temperature of from 1150° to 1210° C, and said ageing is performed at a temperature of from 700° to 820° C.

26. A process according to claim 25, wherein said sintering, and heating at the solution temperature are simultaneous by performed, and immediately after the heating the sintered article is rapidly cooled from said solution temperature to room temperature.

27. A process according to claim 24, wherein said vanadium and said copper are included from 0.5 to 3% by weight and from 9 to 15% by weight, respectively.

28. A process according to claim 27, wherein said pressing is performed at a pressure of 2 to 5 ton/cm$^2$, while a magnetic filed is applied to the powder being pressed, said sintering is performed at a temperature from 1150° C to 1210° C under vacuum, said solution treatment is performed at a temperature of from 1150° to 1210° C, and said ageing is performed at a temperature of from 700° to 820° C.

29. A process according to claim 28, wherein said sintering and heating at the solution temperature are simultaneously performed, and immediately after the heating the sintered article is rapidly cooled from said solution temperature to room temperature.

* * * * *

UNITED STATES PATENT OFFICE

CERTIFICATE OF CORRECTION

Patent No. 4,047,982 Dated September 13, 1977

Inventor(s) Masato Sagawa et al.

It is certified that error appears in the above-identified patent and that said Letters Patent are hereby corrected as shown below:

Column 5, line 62, "tion" should not be indented;
Column 5, line 64, "," should be -- . --;
Column 8, Table IV, "Oe G" should be -- Oe·G --;
Column 8, line 52, "1515" should be -- 15 and --;
Column 10, line 65, "filed" should be -- field --.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*

UNITED STATES PATENT AND TRADEMARK OFFICE

CERTIFICATE OF CORRECTION

PATENT NO. : 4,047,982

DATED : September 13, 1977

INVENTOR(S) : Sagawa et al

It is certified that error appears in the above-identified patent and that said Letters Patent are hereby corrected as shown below:

In Table 1, Sample No. 10, "$RCo_{5.5}$" should be changed to -- $RCo_{8.5}$ -- and "$Sm(Co_{0.75}\ Cu_{0.2}\ V_{0.05})_{5.5}$" should be changed to -- $Sm(Co_{0.75}\ Cu_{0.2}\ V_{0.05})_{8.5}$ --;

In Table 1, Sample No. 18, "$V_{0.05}$" should be changed to -- $V_{0.005}$ --;

UNITED STATES PATENT AND TRADEMARK OFFICE

CERTIFICATE OF CORRECTION

PATENT NO. : 4,047,982

DATED : September 13, 1977

INVENTOR(S) : Sagawa et al

It is certified that error appears in the above-identified patent and that said Letters Patent are hereby corrected as shown below:

Claim 1 should be corrected to read as follows:

1. In a permanent magnet of an RCo type, wherein the R component is one or more rare earth elements and the component Co is cobalt or both cobalt and iron, and the molar ratio of said R component to said Co component is from 1:5 to 1:8.5, an improvement comprising replacing a part of said Co component with both vanadium and copper are included in an amount of from 0.5 to 6% by weight and from 7 to 19% by weight, respectively, based on said components R and Co.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*